United States Patent [19]

Hamo

[11] Patent Number: 4,917,859

[45] Date of Patent: Apr. 17, 1990

[54] DEWAXING PROCESS FOR METAL POWDER COMPACTS MADE BY INJECTION MOLDING

[75] Inventor: Kazunori Hamo, Chiba, Japan

[73] Assignee: Mitsubishi Steel Mfg. Co., Ltd., Tokyo, Japan

[21] Appl. No.: 403,458

[22] Filed: Sep. 6, 1989

[51] Int. Cl.[4] ..... B22F 1/00

[52] U.S. Cl. ..... 419/36; 419/37; 419/54; 419/55; 419/57; 419/60

[58] Field of Search ..... 419/36, 37, 57, 60, 419/54, 55

[56] References Cited

U.S. PATENT DOCUMENTS

| | | | |
|---|---|---|---|
| 4,108,649 | 8/1978 | Moskowitz | 419/37 |
| 4,139,374 | 2/1979 | Yih et al. | 419/36 |
| 4,519,839 | 5/1985 | Toyoaki et al. | 419/37 |
| 4,591,481 | 5/1986 | Lueth | 419/36 |
| 4,721,599 | 1/1988 | Nakamura | 419/36 |
| 4,740,352 | 4/1988 | Takahashi | 419/36 |
| 4,800,064 | 1/1989 | Kemp et al. | 419/36 |

*Primary Examiner*—Stephen J. Lechert, Jr.
*Attorney, Agent, or Firm*—Flynn, Thiel, Boutell & Tanis

[57] ABSTRACT

The present invention provides a dewaxing process for metal powder compact which comprises the steps of embeding in alumina powder an injection-molded metal powder compact consisting of metal powder and an organic binder including low melting point substances; heating the embeded compact to a temperature of 200° C. in a chemically inert atmosphere in a dewaxing furnace, thereby removing the low melting point substances from the compact without deformation of the compact; placing the compact in a closed sintering vessel so as to keep the surrounding temperature constant and disposing the vessel in a vacuum furnace; evacuating the vacuum furnace; and removing the organic binder by heating to a temperature of 550° to 650° C. at a heating rate of 300° to 600° C./hr while supplying an inert gas into the vacuum furnace. According to the dewaxing process, the organic binder can be removed at low cost and in a reduced processing time without causing problems, like blistering and cracking.

1 Claim, 1 Drawing Sheet

DEWAXING PROCESS FOR METAL POWDER COMPACTS MADE BY INJECTION MOLDING

BACKGROUND OF THE INVENTION

1. Field of The Invention

The present invention relates to the field of preparing metallic sintered parts from compacts of metal powder which are obtained by injection molding techniques, and, more specifically, relates to a dewaxing process for removing an organic binder constituent from the injection-molded metal powder compacts with a high efficiency and at a low processing cost.

2. Description of the Prior Art

In recent years, a process for obtaining sintered articles from injection-molded metal powder compacts has attracted attention as an interesting process because it makes possible the mass production of sintered articles having various complicated shapes with ease as compared with other processes.

In this process, molding metal powder is mixed with an organicbinder consisting of various combinations of polymer and wax while being heated and the resulting mixture is molded into a compact according to an injection-molding procedure usually used in the field of plastics. The resulting compact is then subjected to dewaxing and sintering to provide a sintered metal product.

In this production process, "dewaxing" means removing the organic binder from the compact prior to sintering and the organic binder should be removed as fluid (liquid or gas) without causing deformation of the compact.

Methods for the organic binder removal are roughly classified into the following two types, namely, (1) extraction, such as solvent extraction or supercritical gas extraction; and (2) heating.

However, the above dewaxing methods heretofore practiced are disadvantageous in that they are unacceptably costly and require an unduly long treating time, for example, 3 to 5 days. Further, the known dewaxing methods are applicable only to the production of thin sintered products of the order of about 10 mm in thickness. If the treating time is saved in the above conventional dewaxing, problems such as blistering and cracking associated with such dewaxing, occur in injection-molded compacts.

SUMMARY OF THE INVENTION

It is accordingly an object of the present invention to provide a dewaxing process for obtaining sound sintered articles free of the foregoing disadvantages of the conventional dewaxing in which the dewaxing time is significantly saved.

According to the present invention, there is provided a dewaxing process for a metal powder compact made by injection molding, the process comprising the steps of:

embedding in alumina powder a compact made by injection molding a mixed molding material consisting of metal powder and an organic binder including low melting point substances;

heating the embedded compact to a temperature of 200° C. in a chemically inert atmosphere in a dewaxing furnace, thereby removing the low melting point substances incorporated into the organic binder from the compact without causing deformation of the compact;

placing the compact in a closed sintering vessel so as to keep the surrounding temperature of the compact constant and then disposing the vessel in a vacuum furnace;

evacuating the vacuum furnace; and removing the organic binder by heating to a temperature of 550° to 650° C. at a heating rate of 300° to 600° C./hr while supplying an inert gas into the vacuum furnace.

DETAILED DESCRIPTION OF THE PREFERRED EMBODIMENTS

Figure 1:
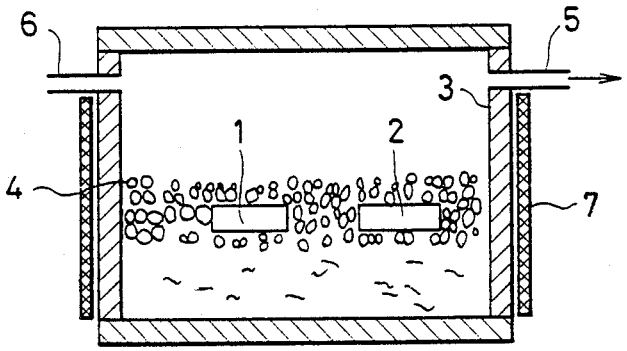
FIG. 1 is a sectional view of an apparatus employed for carrying out a first-stage dewaxing.

The present invention will be more specifically described with reference to the accompanying drawings. Metal powder and an organic binder are mixed under a heated condition and the resulting mixture is injection molded using an injection molding machine, according to an ordinary plastic injection molding process. As the organic binder used in the present invention, for example, acrylate binder or the like is mixed with low melting point substances, such as lubricant, plasticizer, etc. As shown in FIG. 1, the compacts 1 and 2 thus obtained are embedded in alumina powder 4 in a dewaxing furnace 3. The furnace 3 is evacuated through an exhaust pipe 5 and a chemically inert gas such as nitrogen gas is introduced into the furnace 3 through a supply pipe 6. Then, the furnace 3 is heated to about 200° C. by using a heater 7 to remove the low melting point substances (lubricant, wax and plasticizer) contained in the organic binder from the compacts 1 and 2 without causing deformation. In this process, the temperature within the furnace 3 rises linearly from room temperature to 200° C. and, particularly, in compacts having a complicated shape, there is a risk of deformation due to softening during this heating process. In order to overcome the risk, the compacts 1 and 2 are embedded in the alumina powder 4 and are heated in an immovable condition locked in the alumina powder 4. When the low melting point substances, incorporated into the organic binder are removed during the heating process up to 200° C., voids are simultaneously formed in the compacts 1 and 2. Since the thus formed voids penetrate from one face of the compacts 1 and 2 into another face, thermal decomposition products arrive at the surfaces of the compacts 1 and 2 through the voids immediately after thermal decomposition, even if subsequent vacuum dewaxing is conducted by rapid heating, and then the thermal decomposition products are collected into a wax trap 11.

Figure 2:
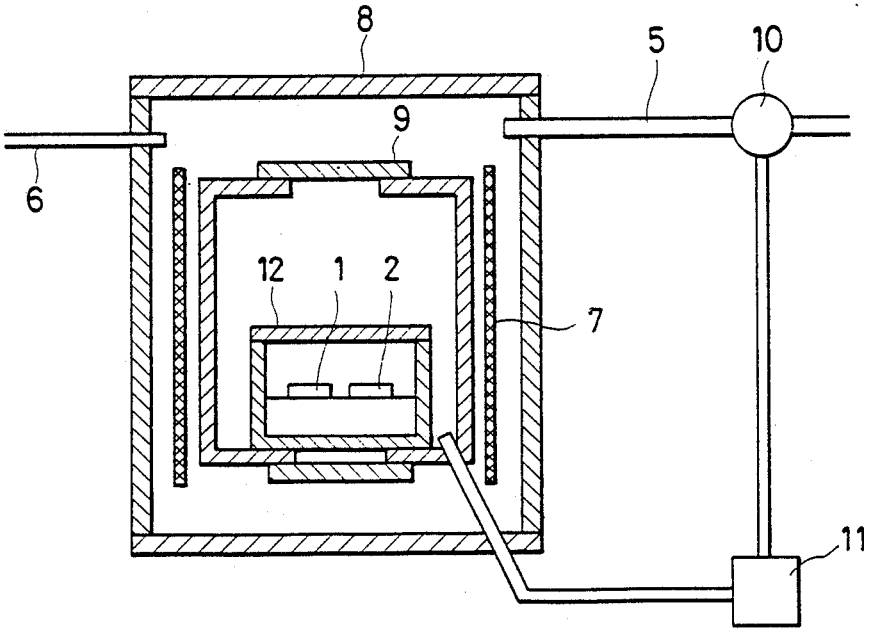
FIG. 2 is a sectional view of an apparatus employed for carrying out a second-stage dewaxing.

Thereafter, as shown in FIG. 2, the compacts 1 and 2 thus treated are transferred into a sintering vessel 12 and placed in a graphite box 9 disposed in a vacuum furnace 8. The vacuum furnace 8 is evacuated using a vacuum pump 10 through an exhaust pipe 5 and heated at a heating rate of 300° to 600° C./hr while supplying an inert gas, e.g., nitrogen gas, through a supply pipe 6.

The inert gas supplied through the supply pipe 6 flows through the clearances existing in and outside the graphite box 9 and is discharged by suction of the vacuum pump 10 via the wax trap 11 disposed outside the vacuum furnace 8. In this step, organic vapor and thermal decomposition gas produced from the organic binder used in the compacts are discharged outside the furnace 8 in the same way as described for the supplied gas and the low melting point organic substances such as wax are collected in the wax trap 11 and solidified.

If the compacts 1 and 2 are placed in an uncovered state in the vacuum furnace 8, heat conduction in the vacuum furnace 8 is caused only by radiation and the surfaces of the compacts 1 and 2 are directly heated. Therefore, there are difficulties in uniformly heating the compacts 1 and 2 and problems, such as warpage, twisting, etc., will arise in the resulting sintered products during the sintering process. Particularly, in the case of sintering a steel powder compact containing a volatile metal component, for example, chromium, aluminum, copper, etc, in a vacuum, if the compact is not enclosed in the foregoing sintering vessel 12 during the sintering step, the volatile metal component preferentially vaporizes from the surface of the sintered compacts, thereby resulting in color change from grey to black in the resulting sintered products. Further, the resulting sintered products are highly susceptible to deformation.

In this invention, since the dewaxing is immediately followed by the sintering step, ceramic materials such as alumina which have a low thermal conductivity as compared with graphite are employed for the dewaxing and sintering vessel 12 and the compacts 1 and 2 are placed in the vessel 12. When the compacts 1 and 2 are dewaxed and subsequently sintered in the vessel 12 made of such materials, there can be obtained satisfactory products which are uniform in shrinkage and have a good metallic luster.

The reason for the limitations of the heating rate of 300° to 600° C./hr and the heating temperature of from 550 to 650° C. is that most of organic binders can be removed at a removal rate of 98.5% by heating to 550° C. and, thus, practically, organic binder removal is sufficiently effected by heating at from 550° to 650° C. The smaller the heating rate, the lower the possibility of defects associated with dewaxing will be. However, in view of the operation efficiency, it is preferable to reduce the dewaxing time. The two-stage dewaxing of the present invention makes possible the foregoing high heating rate of 300° to 600° C./hr without causing any problem.

As described above, dewaxing is performed by the foregoing two steps according to the present invention. If dewaxing is carried out by directly heating the compact under vacuum in a single step, the low melting point constituents and binder resin may be removed from the compacts without transferring operation. However, such dewaxing will cause problems, such as blisters and cracks in the compacts. Therefore, the purpose of the first-stage dewaxing is to cause low melting point constituents in the organic binder, which densely fills up clearances between metal powders, to flow and vaporize, thereby allowing the formation of voids in the compact. Due to such a first-stage dewaxing, even if the second-stage vacuum dewaxing is carried out under rapid heating rates, problems such as blisters and cracks as encountered in known dewaxing operation do not occur in the compact and the dewaxing time can be significantly saved.

The present invention will be more clearly understood with reference to the following Examples.

EXAMPLE 1

100 parts by weight of stainless steel powder (SUS 304L, average particle diameter: 10 μm) was homogeneously mixed with an organic binder consisting of 1.0 part by weight of paraffin wax having a melting point of 50° C., 1.0 part by weight of stearic acid and 7.0 parts by weight acrylate resin under a heated condition at 150° C.

The resulting mixture was powdered and injection molded to provide a compact of block-like test piece 5 mm in thickness for a flexural strength test, using an injection molding machine.

Thereafter, the compact was embedded into alumina powder and placed in a sealed dewaxing furnace. After evacuating the dewaxing furnace to a vacuum of not greater than 1 mm bar, the furnace was filled with nitrogen gas. Then, the compact was heated to 100° C. for a period of 30 minutes while feeding nitrogen gas at a flow rate 2 liter/minute, subsequently heated to 200° C. at a heating rate of 10° C./hr and cooled. After cooling, the alumina powder adhering onto the surface of the compact was removed and the treated compact was placed in a sintering vessel made of alumina. The vessel was closed and disposed. in a vacuum furnace.

After evacuating the vacuum furnace, the compact was linearly heated from room temperature to 600° at a heating rate of 300° C./hr while feeding nitrogen gas at a flow rate of 1 liter per minute and held at that temperature for a period of 30 minutes. Subsequently, sintering was carried out by linearly heating the compact to 1250° C. at a heating rate of 300° C./hr under a high degree of vacuum of not greater than $10^{-3}$ Torr and then holding the same at the temperature for a period of one hour and the sintered compact was cooled.

There was obtained a sound sintered compact in which defects, such as blisters, cracks, etc., associated with the above dewaxing operation were not detected. The resulting sintered compact had a density of 7.6 g/cm$^3$ and a thickness of 4.20 mm and the linear shrinkage percentage was 16.5%. The carbon residue content of the test piece after the foregoing dewaxing treatment up to 600° C. was 0.10% by weight and the carbon residue content after sintering was reduced below 0.01% by weight. The purpose of dewaxing was satisfactorily achieved.

EXAMPLE 2

Instead of the stainless steel powder employed in Example 1, carbonyl iron dust (averagediameter: 6 μm) was mixed with the same organic binder as in Example 1 under a heated condition. The mixing proportion of the organic binder was the same as in Example 1. The mixture was injection molded to a ring-like compact by using an injection molding machine. Subsequently, dewaxing and sintering operations were conducted in the same manner as described in Example 1.

There was obtained a sound sintered compact in which defects such as blisters and cracks, etc., associated with the dewaxing operation were not observed. The density of the sintered compact was 7.4 g/cm$^3$ and the linear shrinkage percentage was 16.5%. The outer diameter of the unsintered compact was 50.0 mm and the outer diameter of the sintered compact was 41.8 mm. Further, while the carbon residue content of the compact was 0.15% by weight after dewaxing by heating to 600° C., it was reduced below 0.01% by weight after the vacuum sintering. It has been found that the dewaxing was satisfactorily effected.

Magnetic measurements were conducted for the sintered compact and the following superior results were obtained, namely; maximum permeability = 2000 μm, magnetic induction $B_{25}(G)=14\ 500$ and coercive force=0.20 Hc(Oe).

According to the present invention, prior to sintering metal powder compacts made by injection molding, dewaxing of the organic binder constituent is effected by the above two-stage dewaxing. The two-stage dewaxing results in a significant reduction of the dewaxing time and prevents carbonization, oxidation of the metal component and other problems like blistering and cracking which may occur in compacts upon dewaxing. Further, the two-stage dewaxing leads to reduction of the carbon residue content of the sintered product and makes a great contribution to the improvements of the qualities of the sintered products obtained from the injection-molded metal powder compacts.

In the first-stage dewaxing, compacts are embedded in the alumina powder and heated to 200° C., so that low melting point constituents, such as lubricant, low melting point wax and plasticizer incorporated in organic binder are gradually and evenly removed from the surface part to the inner part and communicating voids are formed in the compacts. The first-stage vacuum dewaxing frees the compacts from problems such as blisters and cracks even if the compacts are rapidly heated to 600° C. at a heating rate of 300° to 600° C./hr in the second-stage vacuum dewaxing.

What is claimed is:

1. A dewaxing process for a metal powder compact made by injection molding, the process comprising the steps of:

embedding in alumina powder a compact made by injection molding a mixed molding material consisting of metal powder and an organic binder including low melting point substances;

heating said embedded compact to a temperature of 200° C. in a chemically inert atmosphere in a dewaxing furnace, thereby removing said low melting point substances incorporated into said organic binder from said compact without causing deformation of said compact;

placing said compact in a closed sintering vessel so as to keep the surrounding temperature of said compact constant and disposing said vessel in a vacuum furnace;

evacuating said vacuum furnace; and removing said organic binder by heating to a temperature of 550° to 650° C. at a heating rate of 300° to 600° C./hr while supplying an inert gas into said vacuum furnace.

* * * * *